United States Patent [19]

Rusbach

[11] 3,956,965

[45] May 18, 1976

[54] EXCENTRIC SUPPORT SPINDLE

[75] Inventor: Maurice Rusbach, Vernier-Geneva, Switzerland

[73] Assignee: Sarmac S.A., Carouge, Geneva, Switzerland

[22] Filed: May 7, 1974

[21] Appl. No.: 467,809

[30] Foreign Application Priority Data

May 15, 1973 Switzerland ..... 6935/73

[52] U.S. Cl. ..... 89/41 A; 74/571 M

[51] Int. Cl.[2] ..... F41G 7/14

[58] Field of Search ..... 74/571 M, 571 R; 89/41 A

[56] References Cited

UNITED STATES PATENTS

| | | | |
|---|---|---|---|
| 2,860,015 | 11/1958 | Matterson | 74/571 R |
| 2,985,474 | 5/1961 | Cook | 74/571 X |
| 3,550,300 | 12/1970 | Röder | 89/41 A X |

*Primary Examiner*—Samuel Scott
*Assistant Examiner*—F. D. Shoemaker
*Attorney, Agent, or Firm*—Young & Thompson

[57] ABSTRACT

The invention relates to a support which comprises a spindle at the ends of its usable length two resting bosses, concentric with its axis in neutral position, the one being fixed and the other being displaceable by a varying excentricity. Thereby it is possible to displace the axis of the spindle within a cone the summit angle of which is given by the constructional characteristics of said spindle.

11 Claims, 15 Drawing Figures

EXCENTRIC SUPPORT SPINDLE

The present invention relates to an excentric support comprising a simple double excentric system as well as electric transmission means for the firing of primers.

The excentric system permits one to angularly vary the position of the axes of the support with respect to its frame.

This support comprises also a retaining ratchet to ensure the fixing of a firing casing comprising a plurality of self propelled projectiles.

On the same launching support several supports may be mounted, for example in a series of three or four.

The casing will thus have firing angles which will be rendered different the one from the other by the adjustment of the excentricity of each support.

This invention has for its object a support having a variable excentricity characterized by the fact that it comprises a spindle presenting a fixed boss as well as a boss of adjustable excentricity.

The attached drawings show schematically and by way of example five embodiments of the supports according to the invention.

Figure 12:
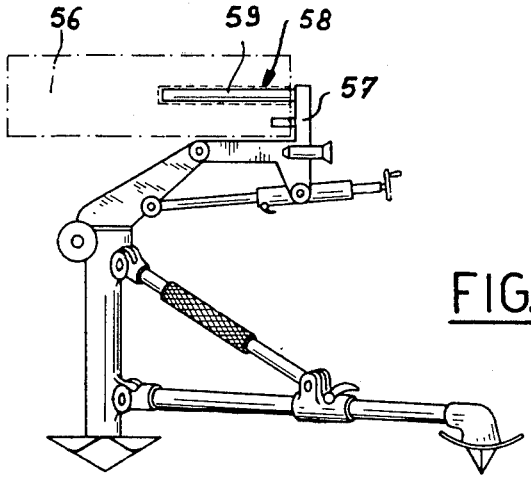
Figure 13:
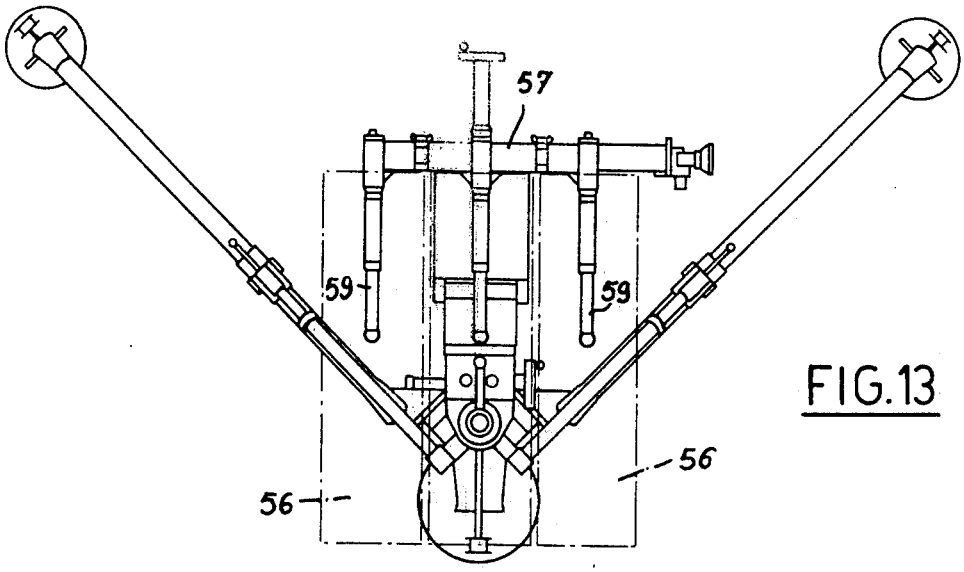
Figure 14:
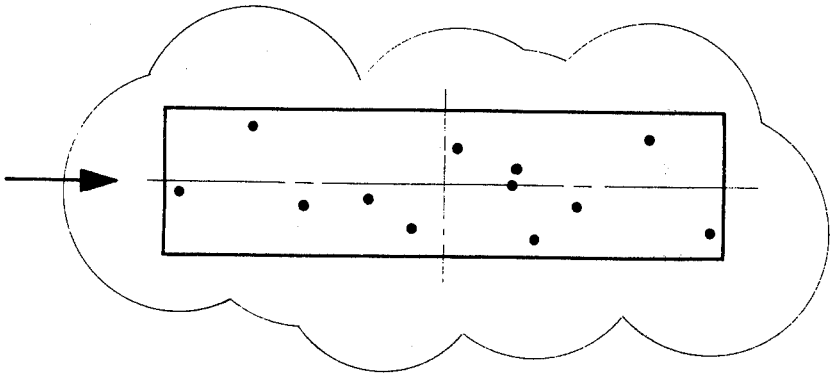
Figure 15:
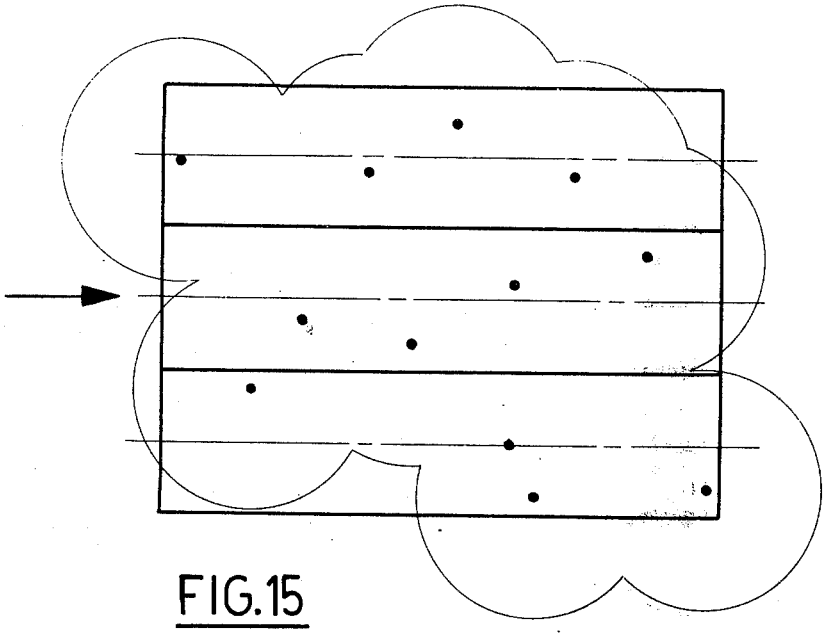

FIGS. 12 and 13 are elevational and top plan views, respectively, of a sixth embodiment of the invention; and FIGS. 14 and 15 are impact patterns of projectiles fired by the device of FIGS. 12 and 13.

Figure 1:
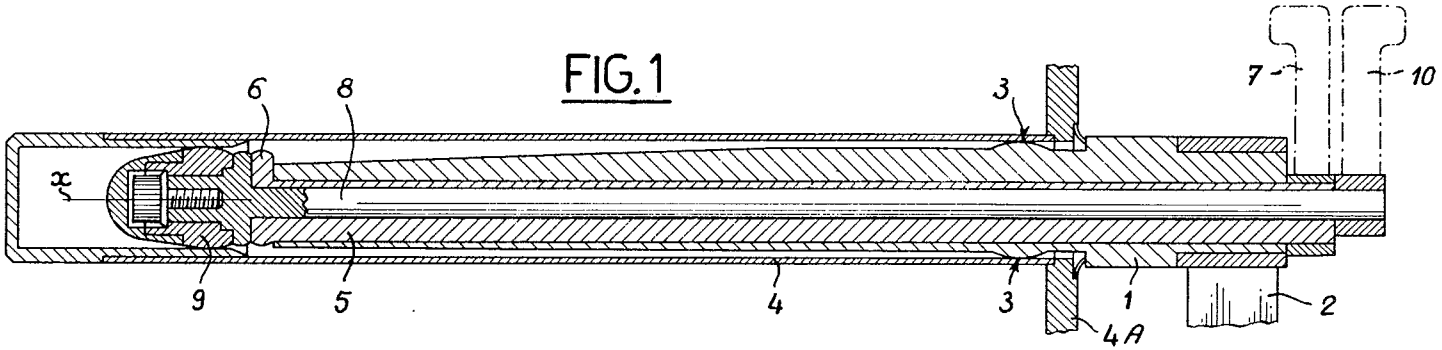
FIGS. 1 and 2 show in cross section and in side view the support, the regulating device of the throw being in active position.
Figure 2:
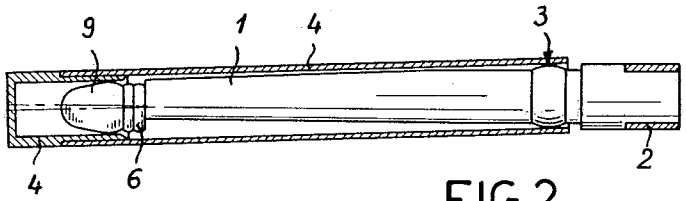

Referring now to the drawings in greater detail, and first to the embodiment of FIG. 1:

The spindle 1 is fixed in the vicinity of its rear end to a support 2 and comprises a first shoulder 3 intended to enter in contact with the internal surface of a sleeve 4 fastened in the object, for example a launching casing 4a which is to be mounted on to the spindle.

The spindle 1 comprises an excentric bore in which a rod 5 is rotatively mounted the front end of which is provided with an ambutment 6 resting on the frontal edge of the spindle 1 and with a rear end which emerges from the spindle 1 and is provided with a control member 7.

In the excentric bore of this rod 5 a rod 8 is rotatively mounted and is provided at its front end with an axle which is excentric and on which is mounted freely rotatable a boss 9 in contact with the internal surface of the sleeve 4.

Figure 3:
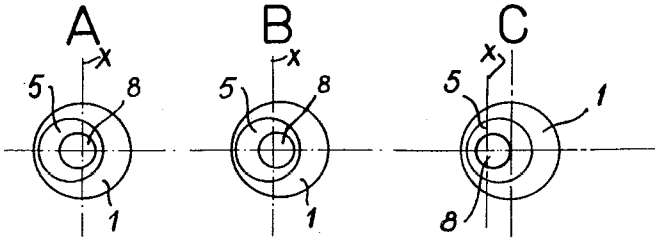
FIG. 3 shows different positions of the support.

In FIG. 3A the spindle 1 is in neutral position. It is coaxial with boss 9.

In FIG. 3B, the rod 8 has been turned 180° toward the left. The axis x of the boss 9 is displaced toward the left with respect to the axis of the spindle 1.

By rotating the rod 5 180°, this rotation adding to the rotation of FIG. 3B, one obtains the FIG. 3C.

The rear free end of the shaft 8 is provided with a control member 10. By activating both control members 7 and 10 it is thus possible to displace the second boss 9 with respect to the first boss 3 in such a way that the axis of the sleeve 4, that is the tangential envelope of these bosses, may take any position within a cone having a summit angle which is given by the dimensions of construction of the spindle 1.

In neutral or rest position the axis of the boss 9 is concentric with the axis of the spindle 1.

Figure 4:
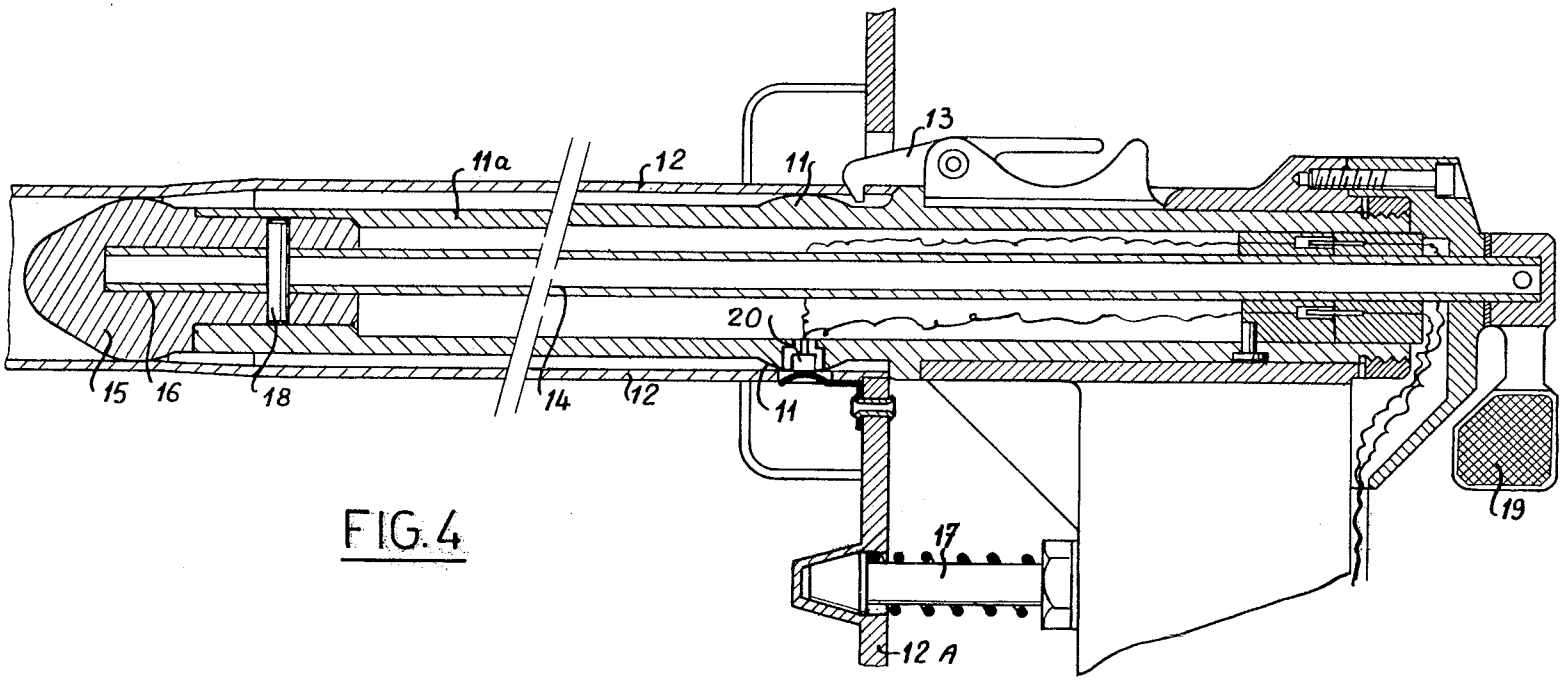
FIG. 4 is a cross sectional view of a second embodiment of the invention.

The second embodiment is represented by FIG. 4.

There the regulating device of the throw comprises a spindle 11*a* which is hollow and the outside surface of which comprises a resting shoulder 11 entering into contact with the internal surface of the centering tube 12.

This centering tube 12 is part of an object, for example a firing casing 12A which is positioned by means of centering pins 17 and retained by a fixing device 13, for example a ratchet.

Within the bore of the spindle a control shaft 14 is located which is displaced with respect of the axis of spindle 11*a*.

At the front end of this control shaft 14 is placed the excentric 15.

The excentric 15 comprises an inside bore 16 where the control shaft 14 is inserted. The retaining pin 18 renders them fast the one with the other.

The rear free end of the control shaft 14 emerging from the spindle is provided with a control member 19. This control member enables one to turn the control shaft 14 and therefore to turn the excentric 15.

The control shaft 14 being displaced with respect to the axis of the excentric spindle it may take any position within a cone the summit angle of which is given by the constructional dimensions of the spindle.

The firing contacts 20 of the primers are fastened to the spindle.

Figure 5:
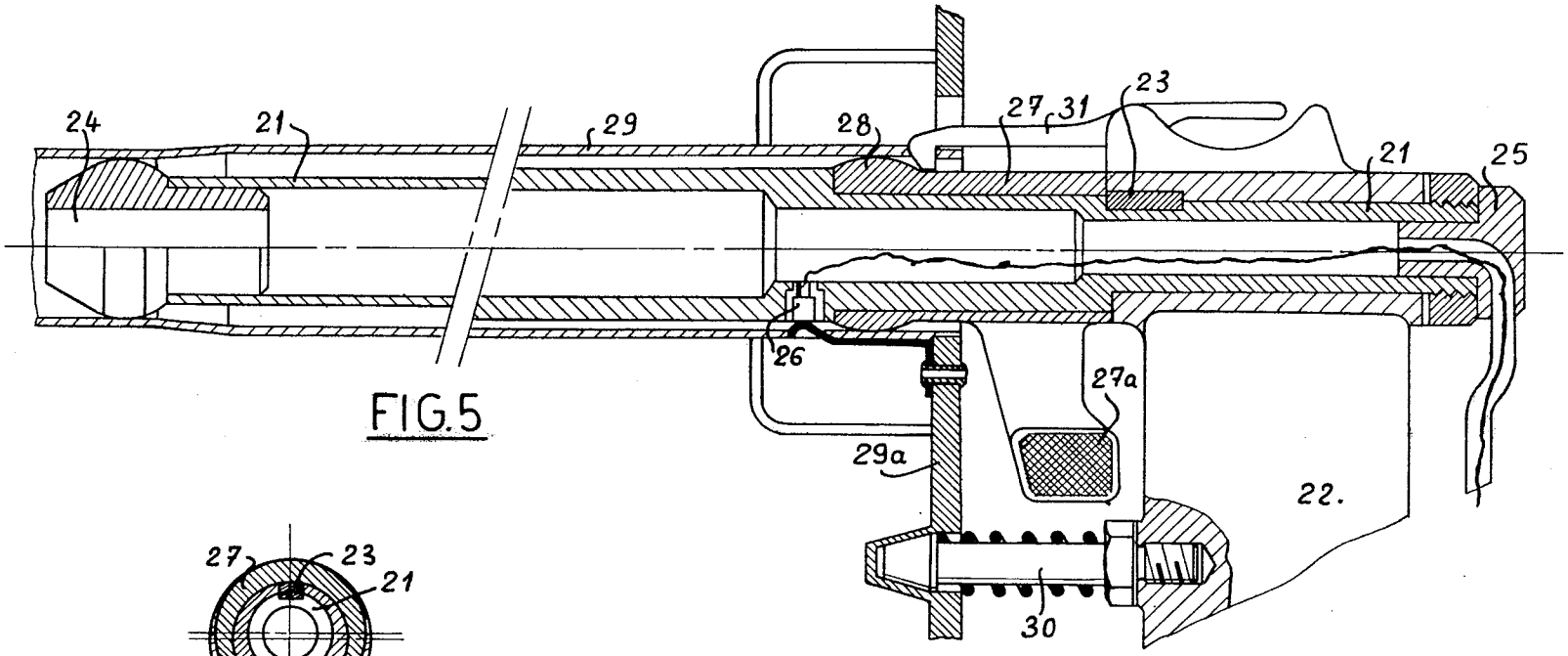
FIGS. 5 and 6 are cross sectional views of the third embodiment of the invention.
Figure 6:
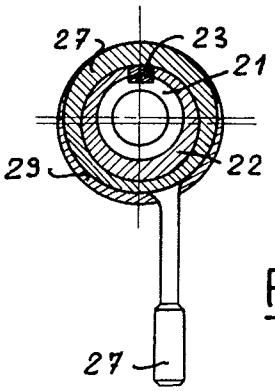

The third embodiment is shown in FIGS. 5 and 6.

The spindle 21 is fastened in the vicinity of its rear end on a support 22. These two parts are fixed by a pin 23.

At the front end of the spindle is located a boss 24 which is driven in.

And at the other end there is screwed a plug 25 which is bored in order to permit the passage of the firing wires for the primers thanks to the contacts 26 which are placed about the middle portion of the spindle.

On the spindle 21 a sleeve 27 is mounted for revolution which spindle has an excentric bore with respect to the diameter of its eccentric shoulder 28 which enters into contact with the internal surface of a centering tube 29. This centering tube 29 is fastened with an object (for example a firing casing 29*a*) which is positioned by a centering pin 30 and retained by a fixing device 31 (for example a ratchet) which is placed on the spindle.

The sleeve 27 comprises further a control member 27a.

The sleeve 27 having an excentric bore is rotatively mounted on the spindle 21, and the rotation of the control member 27a drives thus the displacement of the eccentric shoulder 28. The boss 24, which is driven in the spindle 21, remains still.

The axis of the spindle 21 being displaced with respect to the axis of the sleeve 27, the eccentric shoulder 28 may take any position within a cone the summit angle of which is given by the constructional dimensions of the spindle.

Figure 9:
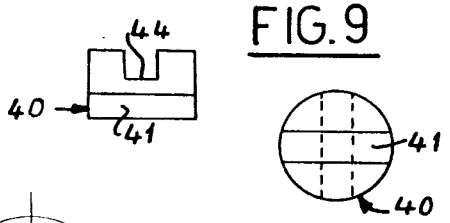
FIGS. 7–9 are fragmentary views in cross section and end elevation of a fourth embodiment of the invention.
Figure 8:
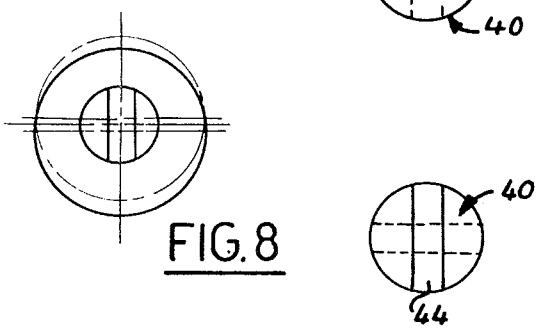
Figure 7:
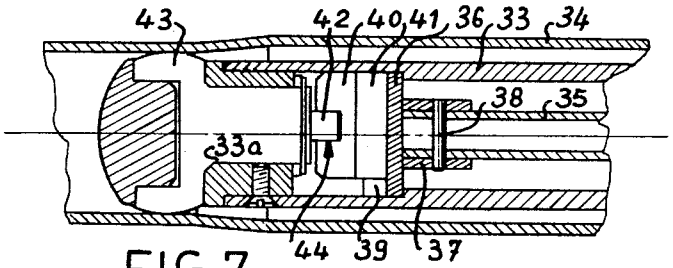

The fourth embodiment is represented by FIGS. 7, 8 and 9.

In neutral position the spindle 33 is concentric with the sleeve 34 fixed within a casing. Spindle 33 comprises at one end an excentric bore used as a bearing for the excentric 43.

The slide 36 comprises an inside bore 37 in which the rod 35 is located. A pin 38 renders them fast the one with the other.

The assembly revolves concentrically with the axis of the spindle 33.

The slide 36 comprises a square groove 39 which is milled.

The cross-slide 40 comprises a portion having a square profile 41 which slides within the groove 39 of the slide 36.

The screw driver portion 42 of the excentric 43 engages within the groove 44 which is milled in the cross slide 40.

The rod 35 revolves concentrically driving the excentric 43 through the intermediary of the cross-slide 40.

Figure 11:
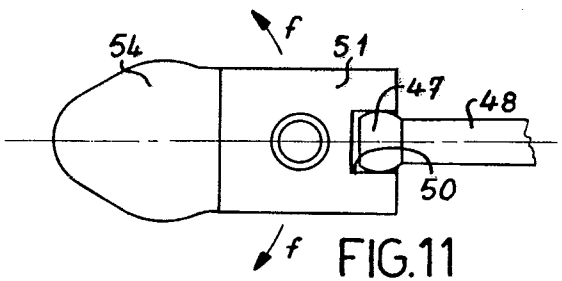
FIGS. 10 and 11 are cross sectional and fragmentary elevational views, respectively, of a fifth embodiment of the invention.
Figure 10:
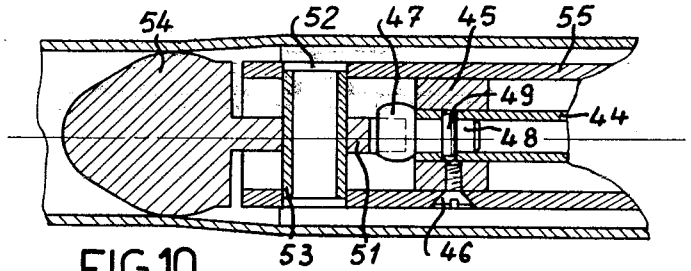

The fifth embodiment is represented by FIGS. 10 and 11.

The spindle is the same as in the case of the fourth embodiment. The front portion of the assembly alone differs.

The rod 44 revolving concentrically traverses a bearing 45 positioned by means of a screw 46 within the spindle 55.

The excentric 47 comprises a stem 48 which is introduced within the rod 44, and a pin 49 fastening them together.

The excentric 47 displaces itself in a groove which is milled in the portion 51 of the part 54. This portion 51 comprises a bore 52 in which a sleeve 53 is located which retains the part 54.

The rod 44 drives by its revolution the excentric 47. This causes a lateral displacement of the part 54 in the direction of the arrow f toward the left or the right.

FIGS. 12 and 13 show a tripod support intended to received firing casings 56 which are used for transportation and storage and contain projectiles which may be re-usable or not.

The support 57 is intended to receive the casings 56 and is a multispindle support, each of the spindles being intended for the fastening of one casing 56, each casing being slid over one spindle, that spindle being located in the tube 58 carried by the frame of the casing.

The casings are slid directly side by side through their rear face on the guiding spindles 59 of the support 57 and retained by a ratchet fastened on each of said spindles.

The support comprises three or four spindles 59 which are parallel in normal position. The spindles are angularly adjustable in the plane of the trajectory and of a height according to the desired throw.

The regulating possibility enables one to choose and to modify the shapes and dimensions of the impact zone of the group of projectiles either by leaving the casings parallel to each other in order to obtain a normally grouped impact (FIG. 14) or by modifying their respective angles of direction to obtain an enlarged impact zone or an elongated impact zone.

FIG. 15 shows an efficiency zone of the firing with the spindles disposed in diverging position. The arrow shows the axis of the firing.

This solution through the multiplicity of the combinations enables one to resolve all the problems caused by different situations encountered in the field.

I claim:

1. Launching and aiming device for self-propelled projectiles housed in containers used as launching tubes, comprising an adjustable support carrying an elongated spindle fast with the said support and having in the vicinity of each of its ends an enlargement for contacting the inside wall of a guiding sleeve of a said container, one of said enlargements being fast with and concentric with the said spindle, and means to displace the other said enlargement transversely of said spindle, said means comprising a control shaft rotatable in a longitudinal bore of said spindle.

2. Device as claimed in claim 1, the enlargement which is movable with respect to the spindle being carried by a second control shaft rotatable in an eccentric longitudinal bore in the first shaft and the first shaft being eccentric with respect to said spindle.

3. Device as claimed in claim 2 in which the fristmentioned shaft is comprised by a tubular rod and said second shaft is comprised by a tubular hollow or plain rod.

4. Device as claimed in claim 2, and manual control members for rotating each of said shafts.

5. Device as claimed in claim 1 in which the fixed enlargement is located at the rear end of the spindle and in which the control shaft is coupled to the other enlargement, the eccentricity of which is adjustable by rotation of this shaft.

6. Device as claimed in claim 1 in which the control shaft is concentric with the spindle and drives in rotation, through a cross slide, said other enlargement, the axis of rotation of which is eccentric with respect to the spindle.

7. Device as claimed in claim 5 in which said other enlargement comprises a fork in which is pivoted an eccentric rotating member on the front end of said control shaft which is concentric with the spindle.

8. Device as claimed in claim 1, said guiding sleeve comprising a cylindrical sleeve surrounding and carried by said enlargements.

9. Launching and aiming device for self-propelled projectiles housed in containers used as launching tubes, comprising an adjustable support carrying an elongated spindle fast with the said support and having in the vicinity of each of its ends an enlargement for contacting the inside wall of a guiding sleeve of a said container, one of said enlargements being fast with and concentric with said spindle, and means to displace the other said enlargement transversely of said spindle, said means comprising a sleeve surrounding the spindle, said sleeve being rotatable on said spindle about an axis parallel to but spaced from the axis of the spindle, said other enlargement being carried by said sleeve.

10. Device as claimed in claim 9, and a control member on said sleeve for rotating said sleeve relative to said spindle.

11. Device as claimed in claim 9, said guiding sleeve comprising a cylindrical sleeve surrounding and carried by said enlargements.

* * * * *